United States Patent [19]

Hoagland

[11] Patent Number: 4,773,566

[45] Date of Patent: Sep. 27, 1988

[54] HOT MELT ADHESIVE APPLICATOR

[75] Inventor: John C. Hoagland, Springfield, Mass.

[73] Assignee: Monsanto Company, St. Louis, Mo.

[21] Appl. No.: 469,552

[22] Filed: Feb. 25, 1983

[51] Int. Cl.[4] ..... B67D 5/62

[52] U.S. Cl. ..... 222/146.5; 222/508; 222/516; 222/542

[58] Field of Search ..... 222/146 H, 146 HE, 146 R, 222/505, 508, 516, 517, 556, 542; 239/569, 526; 251/309

[56] References Cited

U.S. PATENT DOCUMENTS

| | | | |
|---|---|---|---|
| 2,567,960 | 9/1951 | Myers et al. | 222/146 HE |
| 2,659,628 | 11/1953 | Beach | 239/526 |
| 3,091,233 | 5/1963 | Dunlap | 222/146 HE |
| 3,438,387 | 4/1969 | Scaramucci | 251/309 |
| 3,485,417 | 12/1969 | Cocks | 222/146 HE |
| 3,764,045 | 10/1973 | Ornsteen | 222/146 HE |
| 3,971,492 | 7/1976 | Lockwood | 222/146 HE |
| 4,099,653 | 7/1978 | Scholl et al. | 222/146 HE |
| 4,245,759 | 1/1981 | Baker et al. | 222/146 HE |

*Primary Examiner*—Joseph J. Rolla

*Attorney, Agent, or Firm*—R. Bruce Blance; William J. Farrington; Linda L. Lewis

[57] ABSTRACT

A hot melt adhesive applicator capable of dispensing relatively large volumes of molten adhesive at relatively fast rates, comprising a barrel and rotary valve block mounted in a housing and a rotary valve to control the flow of the molten adhesive through the barrel. Heaters attached to the barrel maintain the adhesive in the molten state. Advantageously an arm may be mounted on the spindle of the rotary valve, capable of being moved manually, by electrical or mechanical means to open and close the valve. Compression seals mounted on the valve spindle prevent seepage of molten thermoplastic from the valve block. The passage in the rotary valve can be selected to provide a low pressure drop in the applicator.

8 Claims, 5 Drawing Sheets

Fig. 3.
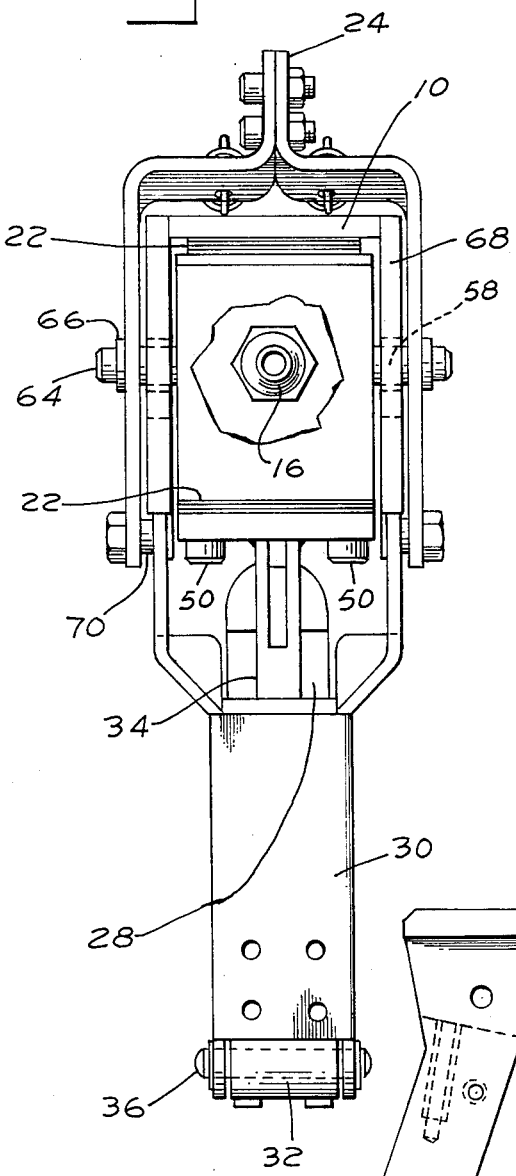
Fig. 4.
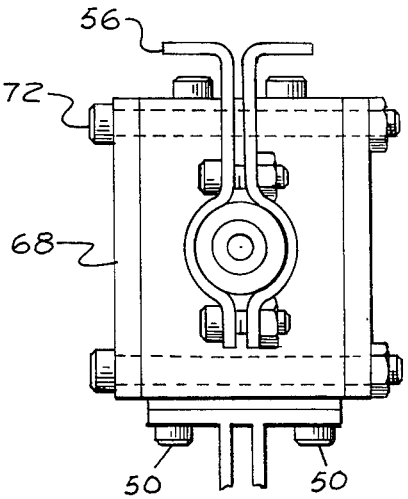
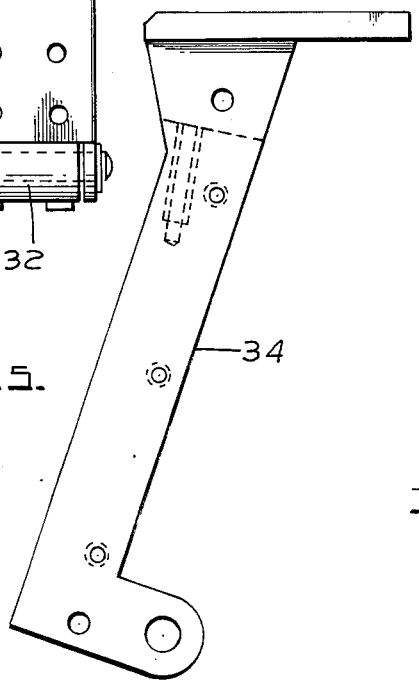
Fig. 5.
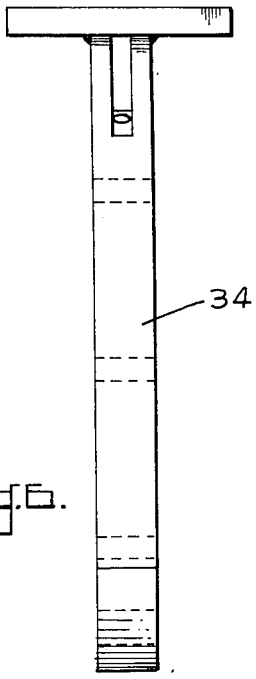
Fig. 6.

Fig. 7.
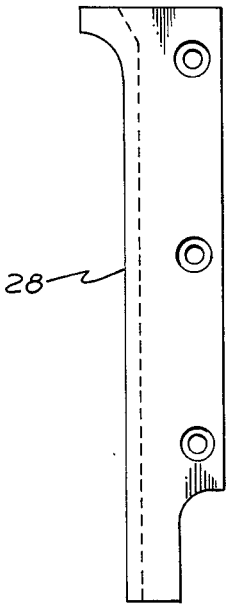
Fig. 8.
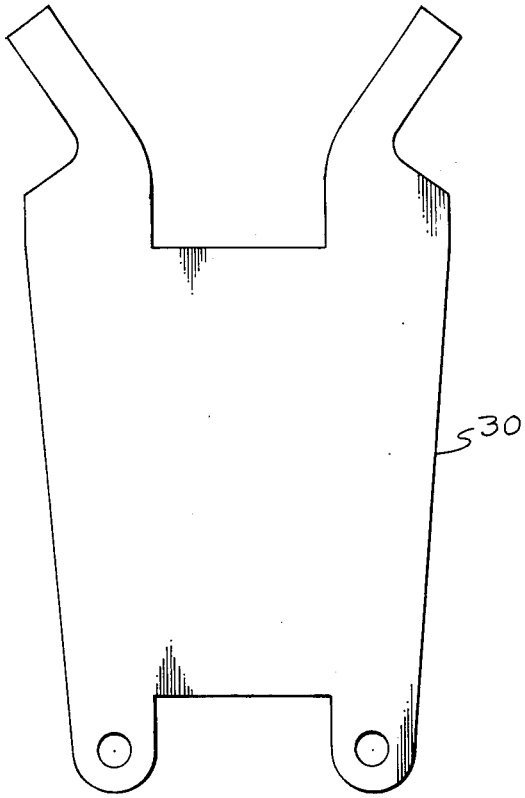
Fig. 9.
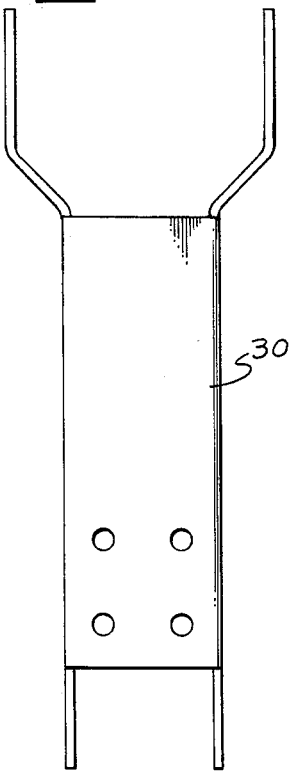
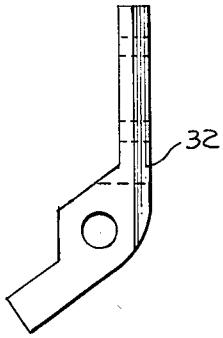
Fig. 10.
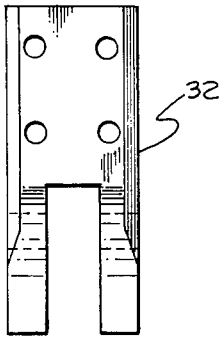
Fig. 11.

Fig. 12.
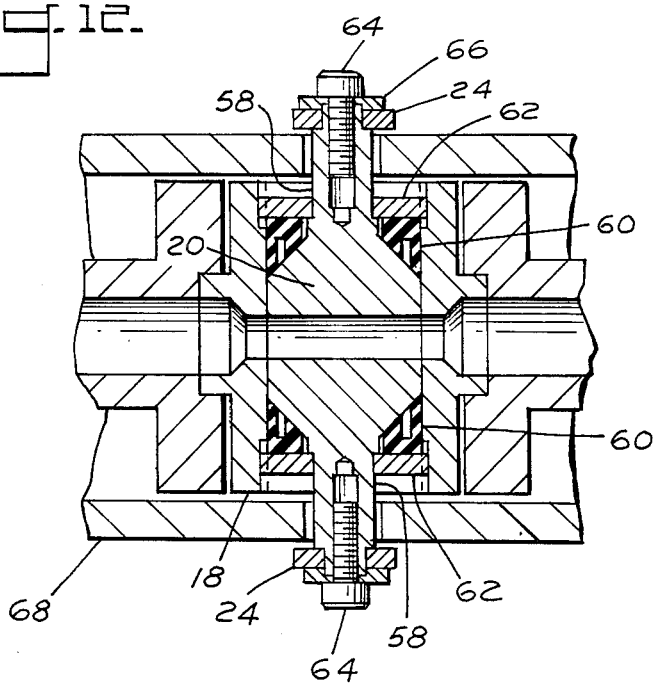
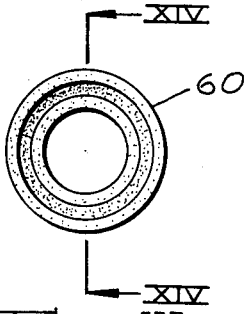
Fig. 13.
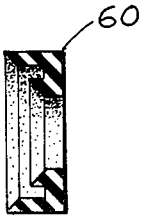
Fig. 14.

HOT MELT ADHESIVE APPLICATOR

BACKGROUND OF THE INVENTION

The present invention relates to a hot melt adhesive applicator and more particularly to a hot melt adhesive applicator capable of dispensing relatively large volumes of molten adhesive at relatively fast rates.

Hot melt adhesive applicators and guns are used to dispense molten adhesive. Such applicators many contain a heating chamber into which a solid cartridge of adhesive is fed and from which molten adhesive is discharged or they may be attached to a hose or pipe which supplies molten adhesive from a reservoir. A trigger operated spring-loaded needle valve usually controls the discharge of adhesive from the applicator and limits the dispensing capability to relatively small rates of flow of molten adhesive because of the narrow passage provided to the molten adhesive in such needle valve systems, such passage often being further constricted by the valve actuating means. A large pressure drop occurs in these applicators.

In recent times, large molded plastic parts such as fenders, doors, fire-walls, tailgates, hoods, and trunk lids for automobiles and trucks have been developed. The complexity of such parts makes one piece molding difficult to carry out. Consequently complete assemblies are fabricated by adhering two or more parts together. Assembly line manufacture of such parts requires intermittent, fast delivery of adhesives.

I have now invented a hot melt adhesive applicator incorporating a rotary valve, which is capable of dispensing relatively large volumes of molten adhesive at relatively fast rates. The applicator also possesses the advantage of sharp interruption in flow of molten adhesive when the valve is closed so that dripping or drooling of adhesive is prevented. The applicator comprises:

(a) a barrel mounted in a housing, the barrel having a rear section for receiving a supply of molten thermoplastic and a front section terminating in a nozzle for discharge of molten thermoplastic;

(b) heating means and temperature sensors attached to the barrel to maintain the thermoplastic in the molten state;

(c) interposed between the rear and front sections of the barrel, a valve block with a rotary valve rotably mounted in the valve block, the rotary valve containing a passage to allow flow of molten thermoplastic from the rear section to the front section of the barrel when the valve is open; and (d) means mounted on the rotary valve to cause the valve to open and close. A seal or seals mounted on the rotary valve spindle prevent seepage of molten thermoplastic from the valve block. Advantageously, the clearance between the rotary valve and the rotary valve block is less than 0.1 mm. For hot melt adhesives applied at temperatures less than about 150° C. elastomeric seals may be used advantageously. For hot melt adhesives used in structural aplications and applied at temperatures above 150° C., such elastomeric seals are unsatisfactory since they tend to degrade or become embrittled and fail after a very short period of service. For applications above 150° C., metal compression seals made of a suitable metal or metal alloy are more satisfactory. The seals engage in contoured fit against shoulder regions of the valve between the valve spindle and the wider portion of the valve which mates with the valve seat in the valve block.

The barrel is divided into two sections with the valve block interposed. The rear barrel section which receives molten thermoplastic adhesive and delivers it to the valve block and the front barrel section which receives molten thermoplastic adhesive from the valve block and delivers it to the applicator nozzle from which the molten adhesive is discharged, may be co-axial or may be placed at an angle to one another, with the front barrel section at an angle, to allow downward discharge of the molten adhesive. Alternatively the front barrel section may be co-axial with the rear barrel section at the receiving end adjacent to the valve block and may be inclined at the discharge end to allow downward discharge of molten adhesive. Preferably the front and rear barrel sections are co-axial to allow substantially linear flow of the adhesive in the applicator and to avoid dead spots in which thermoplastic stagnates and degrades.

The rotary valve can be a plug valve of cylindrical or truncated cone shape or a ball valve seated in a channel in the valve block adapted to receive the valve so that the surfaces of the valve and the channel are in substantially sealing contact. The valve has a suitably shaped passage bored into it, for example the passage may be circular, oblong circular or elliptical in cross-section. The passage is aligned with the discharge end of the rear barrel section and the receiving end of the front barrel section when the valve is open to allow flow of molten adhesive. For ease of assembly the valve is preferably a plug valve of cylindrical or truncated cone shape in the section which mates with the channel in the cylinder block. When the valve is a ball valve the valve block is made of two pieces which sealingly engage one another after the valve has been seated in its channel. To actuate the valve, an arm can advantageously be attached to the valve spindle, to provide a pivoting action. The arm may be moved manually, by electrical solenoid, by mechanical screw or by pneumatic or hydraulic means.

In a convenient means of manual operation, the arm is bifurcated and attached to the opposite ends of the spindle of the valve and a bifurcated pressure responsive lever acts on the two forks of the arm to open the valve when pressure is applied on the lever in opposition to springs which move the valve to the closed position when pressure on the lever is removed.

These and other features of the invention are illustrated in the drawings.

FIG. 3 is a front elevation partly in section of the embodiment of FIG. 1.

FIG. 4 is an elevational view of the rear of the gun.

FIG. 5 is a side elevation of the trigger T-bar.

FIG. 6 is a front elevation of the trigger T-bar.

FIG. 7 is a side elevation of the handle attached to the trigger T-bar.

FIG. 8 is a flattened view of the handle which is hingedly attached to the trigger T-bar.

FIG. 9 is a front elevation of the handle of FIG. 8.

FIG. 10 is a flattened view of the hinge which is attached to the handle of FIG. 8.

FIG. 11 is a side elevation of the hinge of FIG. 10.

FIG. 12 is a horizontal sectional view of the valve block and valve taken along line XII—XII of FIG. 2.

FIG. 13 is a frontal elevation of a valve seal.

FIG. 14 is a side sectional view of the valve seal of FIG. 13 taken along line XIV—XIV.

Figure 1:
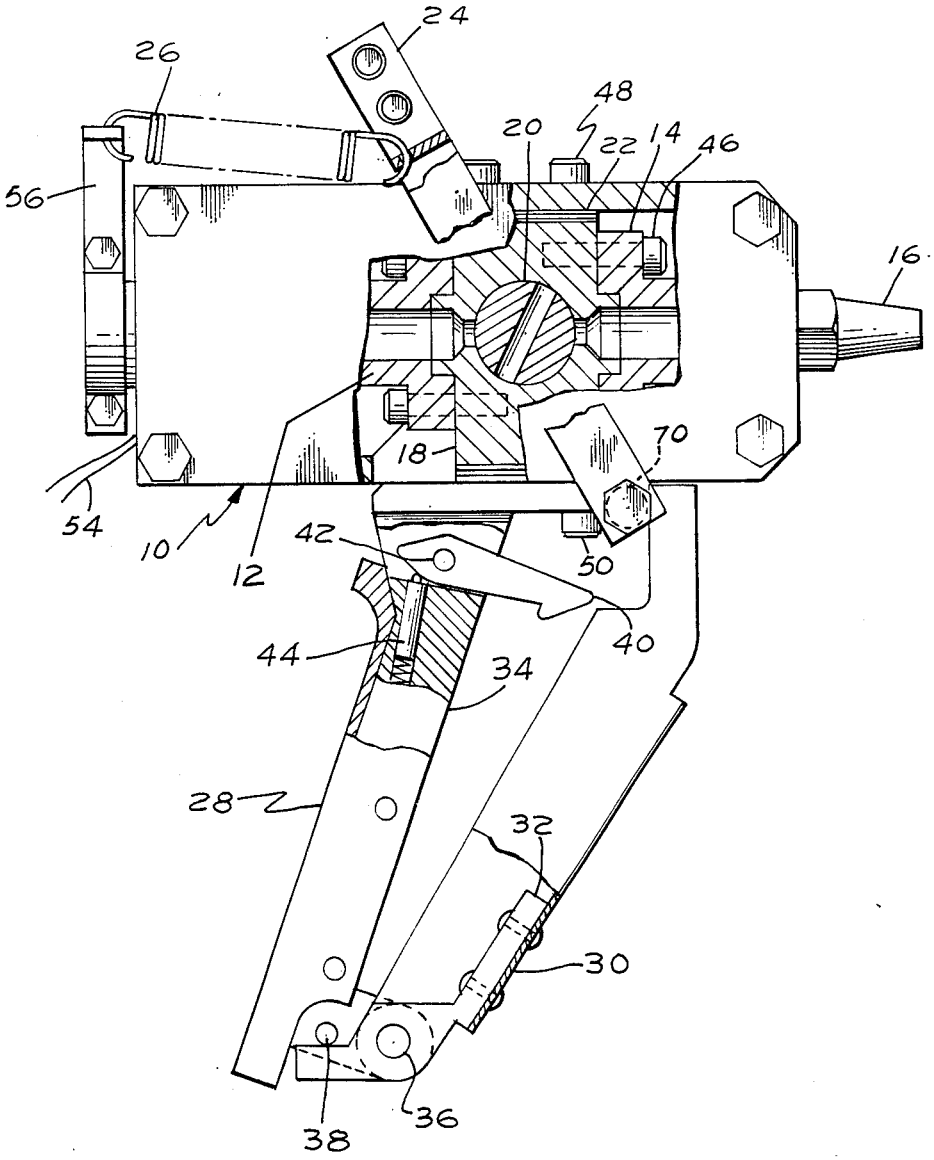
FIG. 1 is a sectional side elevation of a manually operated hot melt gun according to the invention with the gun valve in the closed position.

The figures are for the purpose of illustrating the invention and are not intended to limit its scope.

The applicator comprises a housing consisting of a body 10 and side covers 68. Mounted in the body is the metal barrel consisting of the rear barrel section 12, FIG. 1, the front barrel section 14 to which the discharge nozzle 16 is attached, and the metal valve block 18, in the cylinder of which the metal valve 20 is rotatably mounted and on the under side of which the supporting structure for the handle, a metal T-bar 34 is mounted. Placed between the body 10 and the valve block 18 and between the valve block 18 and the T-bar 34 are strips of a suitable insulator 22 such as sheet asbestos or plastic laminate. Attached to the spindle of rotary valve 20 is an arm 24. As FIG. 3 shows, the arm is conveniently bifurcated and attached to both ends of the valve spindle to provide an even pressure on the valve and is acted upon by the two coil springs 26 to cause the valve to remain in the closed position shown in FIG. 1. Mounted on the T-bar 34 is a grip 28 made of any suitable plastic or plastic laminate material, and hingedly attached to the T-bar by hinge 32 and pin 36, is a handle 30 which is bifurcated as shown in FIG. 3, so that the upper ends of the forks engage against studs 70 attached to the lower ends of the forks of arm 24. A dowel 38 attached to T-bar 34 engages the lower end of hinge 32 and prevents handle 30 from travelling further to the right than the position shown in FIG. 1 with the valve 20 in the closed position. When handle 30 is moved to the left to cause valve 20 to open as shown in FIG. 2, latch 40 attached to T-bar 34 by dowel 42, engages handle 30 to maintain the valve in the open position without further manual effort. Plunger 44 holds the latch 40 in engagement with handle 30 even when the applicator is turned upside down. Handle 30 is easily released by manually lifting latch 40 whereupon handle 30 pivoting on pin 36, is moved to the right in FIG. 2 by the action of the coil springs 26 on the bifurcated arm 24. A ratchet may be installed on handle 30 to engage latch 40 and provide a controlled degree of opening of the valve and hence control of the rate of discharge of molten thermoplastic. Fasteners 46, 48 and 50 attach the valve block 18 to the barrel sections 12 and 14, the body 10 and the T-bar 34 respectively. A series of heaters 52 are attached to the barrel sections 12 and 14 and are controlled by thermocouples attached to the barrel by means of retaining rings, not shown. The power supply and thermocouple wires enter the body through a channel 54.

Figure 2:
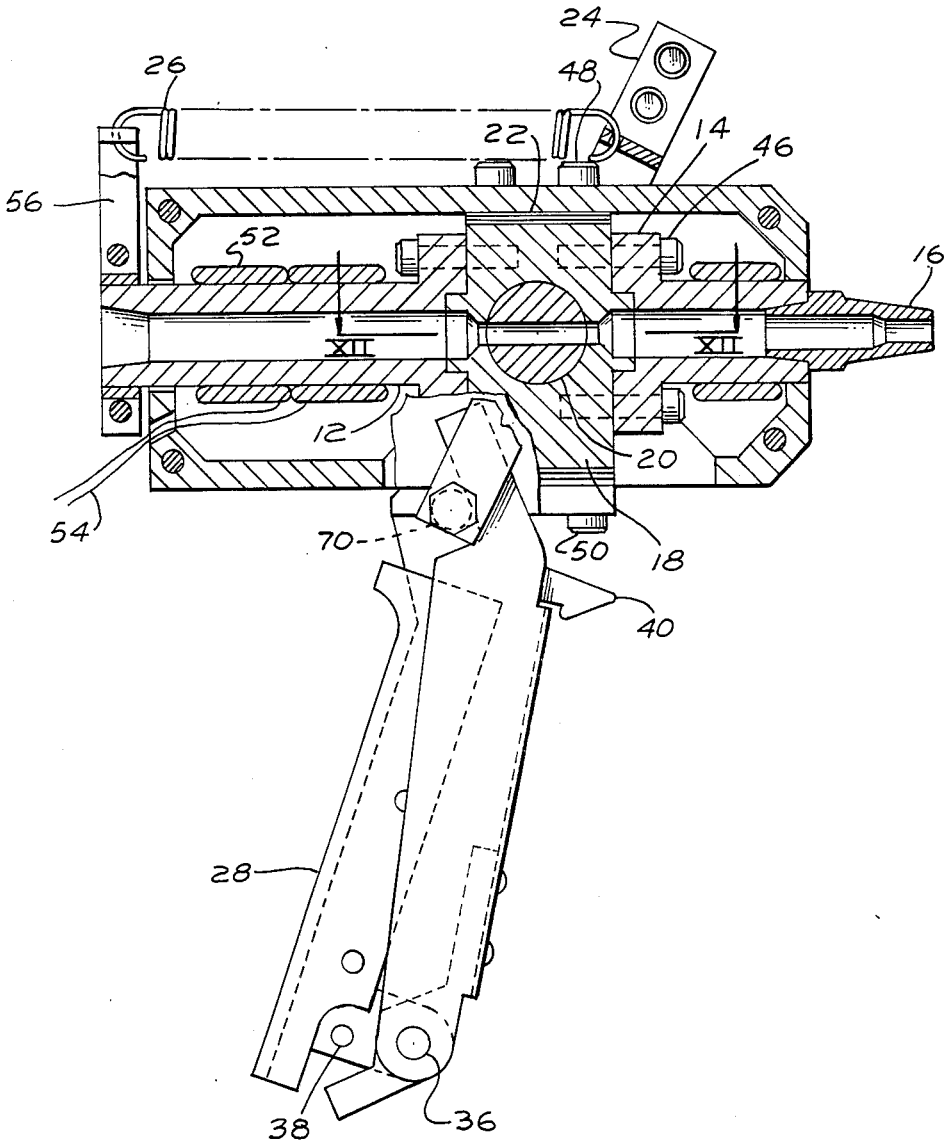
FIG. 2 is a side elevation, partly in section, of the valve and trigger of the embodiment of FIG. 1 with the gun valve open.

FIG. 3 is a front elevation partly in section of the applicator shown in FIGS. 1 and 2. The bifurcated arm 24 is attached to the valve spindle 58 by retaining bolts 64 with washers 66 allowing the arm to pivot on the axis of the rotary valve and hence to open or close the valve. Studs 70 at the end of each arm provide the bearing surfaces for the bifurcated handle 30 which causes the valve to open when it is moved rearwards in pivoting motion about pin 36. T-bar 34 to which the grip 28 and the handle 30 are attached is fastened to the underside of the valve block by fasteners 50.

FIG. 4 illustrates a method of mounting of bracket 56 at the rear of the applicator and shows shows the fasteners 72 for the side covers 68. The rear ends of coil springs 26 (not shown) are attached to the bracket as shown in FIGS. 1 and 2.

FIGS. 5 and 6 illustrate the T-bar in side and front elevation, unencumbered with the grip and handle. FIG. 7 illustrates the grip.

FIG. 8 illustrates the layout of bifurcated handle 30 prior to being bent into the shape illustrated in FIG. 9. FIGS. 10 and 11 illustrate the hinge structure 32 which is used to mount the handle on pin 36.

In FIG. 12, the mounting of the valve 20 in valve block 18 is illustrated by means of a horizontal section taken along line XII—XII of FIG. 2. Bifurcated arm 24 is attached to valve spindle 58 by means of retaining bolts 64 and washers 66 allowing the arm to pivot on the axis of the rotary valve and hence to open or close the valve. Grooved compression seals 60 bear against the valve shoulders and are held against the shoulders by slotted nuts 62 which have a central hole to accommodate the valve spindle and are screwed into the valve block. The groove in the seals allows the seals to be deflected under melt pressure (increasing the width of the groove) thus forcing the seal still tighter against the valve. In addition compression when the slotted nuts are tightened ensures intimate contact of the seal against the valve shoulders.

FIG. 13 is a frontal elevation of a valve compression seal 60 showing the central hole to accommodate the valve spindle and showing the concentric groove. FIG. 14 is a side sectional view taken along the line XIV—XIV of FIG. 13 showing the central hole, the groove and the contour of the surface which mates against the valve shoulder. For high temperature applications the compression seal is preferably fabricated from an aluminum bronze containing about 9 weight percent aluminum.

Since a relatively wide bore can be selected for the flow passage in the rotary valve, relatively high rates of delivery of molten adhesive, many times greater than the rates obtained with conventional hot melt applicators, can be achieved. Thus, provided the cross-sectional area of the flow passage in the rotary valve is at least about twenty-five percent of the cross-sectional area of the applicator barrel, the pressure drop through the valve passage is relatively insignificant. In addition the flow path through the applicator is relatively short and the internal passage shapes within the applicator can be selected as shown in the drawings to provide smooth melt flow and to avoid dead spots where molten adhesive can stagnate and degrade. Therefore with an applicator barrel of circular cross-section of area of at least about 80 $mm^2$, flow rates in the range of 5 to 30 grams per second can be readily obtained with a molten adhesive, the pressure drop between the rear section of the barrel and the discharge nozzle being less than about 6000 kPa.

Instead of the bifurcated arm 24 manually actuated by the handle 30, an arm attached to the spindle of the rotary valve can be moved by a solenoid, by a mechanical screw, by pneumatic or by hydraulic means to open and close the valve. Particularly when the valve is a ball valve or a truncated cone plug valve, the valve spindle may project from one side of the valve block only and thus may have the actuating arm attached to this one end of the spindle only. However, especially when the valve is a cylindrical plug valve, it is preferable that a bifurcated arm similar to the arm shown in the drawings be attached to the spindle and that the arm be acted upon by a bifurcated lever moved by the solenoid, mechanical screw, or pneumatic or hydraulic means.

What is claimed is:

1. An applicator for intermittent application of a molten thermoplastic at a temperature above 150° C., which comprises:

(a) a barrel mounted in a housing, the barrel having a rear section for receiving a supply of molten thermoplastic and a front section terminating in a nozzle for discharge of molten thermoplastic;

(b) heating means and temperature sensors attached to the barrel to maintain the thermoplastic in the molten state;

(c) interposed between the rear and the front sections of the barrel, a valve block with a rotary valve rotatably mounted in the valve block by means of a spindle connected to the valve by truncated conical shoulders, the rotary valve containing a passage to allow flow of molten thermoplastic from the rear section to the front section of the barrel when the valve is open;

(d) grooved metallic compression seals with conical sealing surfaces, the seals being deflected under pressure of the molten thermoplastic to seal against the shoulders of the rotary valve; and (e) an arm mounted on the spindle of the rotary valve which is acted upon by a lever to cause the rotary valve to rotate to the open position and is acted upon by a spring to cause the rotary valve to rotate to the closed position.

2. The applicator of claim 1 wherein the clearance between the rotary valve and its seat in the rotary valve block is less than 0.1 mm.

3. The applicator of claim 1 wherein when the rotary valve is fully open, the flow rate of molten thermoplastic is at least about 5 grams per second and the pressure drop between the rear section of the barrel and the discharge nozzle is less than about 6000 kPa.

4. The applicator of claim 1 wherein the cross-sectional area of the passage in the rotary valve is at least about twenty-five percent of the cross-sectional area of the barrel.

5. The applicator of claim 4 wherein the cross-sectional area of the barrel is at least about 80 $mm^2$.

6. An applicator for intermittent application of a molten thermoplastic at a temperature about 150° C., which comprises:

(a) a barrel mounted in a housing, the barrel having a rear section for receiving a supply of molten thermoplastic and a front secton terminating in a nozzle for discharge of molten thermoplastic;

(b) heating means and temperature sensors attached to the barrel to maintain the thermoplastic in the molten state;

(c) interposed between the rear section and the front section of the barrel, a valve block with a rotary valve possessing truncated conical shoulders, the valve being rotatably mounted in the valve block by means of a spindle connected to the conical shoulders, the rotary valve containing a passage to allow flow of molten thermoplastic from the rear section to the front section of the barrel when the valve is open; and (d) grooved metallic compression seals with conical sealing surfaces, the seals being deflected under pressure of the molten thermoplastic to seal against the shoulders of the rotary valve; and a spring to cause the rotary valve to close; wherein the clearance between the rotary valve and its seat in the rotary valve block is less than 0.1 mm, wherein the compression seals mounted on the rotary valve spindle prevent seepage of molten thermoplastic from the valve block, and wherein the cross-sectional area of the passage in the rotary valve is at least about twenty-five percent of the cross-sectional area of the barrel.

7. The applicator of claim 6 wherein the cross-sectional area of the barrel is at least about 80 $mm^2$.

8. The applicator of claim 6 wherein when the rotary valve is fully open, the flow rate of molten thermoplastic is at least about 5 grams per second the the pressure drop between the rear section of the barrel and the discharge nozzle is less than about 6000 kPa.

* * * * *